US008353607B2

(12) United States Patent
Goncalves et al.

(10) Patent No.: US 8,353,607 B2
(45) Date of Patent: Jan. 15, 2013

(54) LIGHTING OR SIGNALING MODULE WITH IMPROVED THREE-DIMENSIONAL APPEARANCE

(75) Inventors: Whilk Goncalves, Paris (FR); Otavio-Henrique Dos Reis, Osasco (BR)

(73) Assignee: Valeo Vision, Bobigny (FR)

( * ) Notice: Subject to any disclaimer, the term of this patent is extended or adjusted under 35 U.S.C. 154(b) by 679 days.

(21) Appl. No.: 12/504,885

(22) Filed: Jul. 17, 2009

(65) Prior Publication Data

US 2010/0014294 A1 Jan. 21, 2010

(30) Foreign Application Priority Data

Jul. 21, 2008 (FR) ..... 08 04151

(51) Int. Cl.
*F21V 7/09* (2006.01)

(52) U.S. Cl. ..... 362/297; 362/346; 362/518

(58) Field of Classification Search ..... 362/296.06, 362/297, 346, 348, 516, 517, 518, 519, 520
See application file for complete search history.

(56) References Cited

U.S. PATENT DOCUMENTS

| | | | |
|---|---|---|---|
| 4,035,631 | A | 7/1977 | Day, Jr. |
| 4,153,929 | A | 5/1979 | Laudenschlarger et al. |
| 4,704,661 | A | 11/1987 | Kosmatka |
| 4,916,585 | A | 4/1990 | Nino |
| 4,994,947 | A | 2/1991 | Fesko |
| 5,067,053 | A | 11/1991 | Akizuki |
| 5,079,677 | A | 1/1992 | Kumagai |
| 5,692,824 | A | 12/1997 | Ooishi |
| 5,755,503 | A | 5/1998 | Chen et al. |
| 5,980,067 | A | 11/1999 | Albou et al. |
| 6,007,223 | A | 12/1999 | Futami |
| 6,045,245 | A | 4/2000 | Kanou |
| 6,109,772 | A | 8/2000 | Futami et al. |
| 6,244,731 | B1 | 6/2001 | Koiko et al. |
| 6,280,064 | B1 | 8/2001 | Sato et al. |
| 6,474,845 | B1 | 11/2002 | Mabe et al. |
| 6,543,921 | B2 | 4/2003 | Natsume |
| 6,739,743 | B2 | 5/2004 | Koshiro et al. |
| 6,746,634 | B2 | 6/2004 | Shimakura |
| 6,755,556 | B2 | 6/2004 | Gasquet et al. |
| 6,781,759 | B1 | 8/2004 | Wakita et al. |
| 2001/0003506 | A1 | 6/2001 | Natsume |
| 2002/0145882 | A1 | 10/2002 | Shimakura |
| 2008/0175015 | A1 | 7/2008 | Goncalves et al. |
| 2008/0316761 | A1 | 12/2008 | Minano et al. |

FOREIGN PATENT DOCUMENTS

DE 19919704 12/1999

(Continued)

*Primary Examiner* — Y My Quach Lee
(74) *Attorney, Agent, or Firm* — Jacox, Meckstroth & Jenkins

(57) ABSTRACT

A lighting or signaling device for emitting a lighting or signaling beam according to a main direction, of the type comprising a light source, a flux-recovering mirror comprising a set of reflecting tiles, the reflective surface of each reflecting tile being constituted by a first conical segment with two focal points, a first focal point of which is situated on the light source and a second focal point of which is situated, in relation to reflecting tile in a specific direction in relation to the main direction, each reflecting tile forming an image of the light source. A surface of at least one reflecting tile has at least one second conical segment with two focal points a first focal point of which is situated on the light source and a second focal point of which is situated at a distance from the second focal point of the first conical segment with two focal points.

21 Claims, 10 Drawing Sheets

FOREIGN PATENT DOCUMENTS

| | | | |
|---|---|---|---|
| EP | 0678703 | A1 | 10/1995 |
| EP | 0879989 | A2 | 11/1998 |
| EP | 1947382 | A1 | 7/2008 |
| FR | 2627256 | A1 | 8/1989 |
| FR | 2802284 | A1 | 6/2001 |
| GB | 2040431 | A | 8/1980 |
| GB | 2280739 | | 2/1995 |
| GB | 2306637 | | 5/1997 |

LIGHTING OR SIGNALING MODULE WITH IMPROVED THREE-DIMENSIONAL APPEARANCE

CROSS-REFERENCE TO RELATED APPLICATIONS

This application claims priority to French Application No. 0804151 filed Jul. 21, 2008, which application is incorporated herein by reference and made a part hereof.

BACKGROUND OF THE INVENTION

1. Field of the Invention

The present invention concerns a lighting or signaling module, in particular for motor vehicles, which has an improved three-dimensional appearance when it is lit.

The invention is especially suitable for use in the domain of motor vehicles, such as for example, motorized two-wheelers, private cars, light utility vehicles or heavy goods vehicles.

2. Description of the Related Art

The document FR 2 627 256 discloses a signal light consisting essentially of a lamp fitted with a filament, a rear reflector and a transparent deflection element placed forward of the lamp. The rear reflector, in co-operation with the real light source, is designed to create, on a line essentially horizontal and perpendicular to the general direction of emission or optical axis x-x, a plurality of light sources, referred to in this document as virtual, distributed equidistantly on this line. To this effect, the rear reflector is subdivided into a plurality of segments which exhibit the shape of ellipsoids, the first focal point of which is situated on the filament and the second focal point of which is situated at the location of the virtual sources. The transparent deflection element arranged forward of the sources has an essentially constant vertical section, with which a focal point is associated, and designed to deflect rays of light projected from focal point vertically so that they propagate essentially in parallel with a horizontal plane, this element being obtained by a displacement of section such that the focal point essentially follows the line of sources.

An arrangement of this type is intended to produce a signal light of great width in relation to its height, such as for example a third brake light in raised central position. The function of the deflector element arranged forward of the light sources is to act on the angle of site of the rays diverging from the light sources, to return it to a value close to zero, while leaving their azimuth angle practically unchanged.

Moreover, the reflector is designed so that each virtual source emits light rays forwards essentially in the same angular range, in a horizontal median plane, so that all of the illuminating area of the lamp retains a homogeneous appearance from wherever it is observed in this angular range.

The result of this is that the light known from this document presents a homogenous illuminated area, in which the light sources can no longer be distinguished, and with which it is impossible to obtain special aesthetic effects.

There is also known, from the document EP 0 678 703, a vehicle light which comprises a light source cooperating with a reflector, the light being designed to give the effect of a multitude of punctiform, or practically punctiform, light sources. According to this document, the reflector comprises a plurality of lenticular reflective elements, each provided with a convex or concave reflective surface, distributed in a fundamentally uniform way over the surface of the reflector. The reflective elements are arranged in lines, horizontally and vertically parallel, or radial in relation to the longitudinal axis of the light, or they occupy predetermined circular sectors on circumferences or segments of circumferences which are concentric in relation to the lamp.

The reflective elements described by this document have curved, convex or concave surfaces, whose radii of curvature in horizontal and vertical direction are selected independently of each other depending on the light effect desired. The reflective elements are thus visible through a smooth closure glass as a connected plurality of light images.

An embodiment of this type allows very little leeway for the design of the reflective elements, so that no special aesthetic or style effects can be achieved. This document, in fact, makes provision only for matricial or circular configurations for the reflective elements. Moreover, the reflective elements constituting the plurality of images obtained remain localized at the reflector, so that an observer situated outside the axis of emission of the signaling beam sees only part of the plurality of images. Moreover, in order to satisfy the photometric grids demanded by legislation, the rows of reflective elements constituting the reflector have to be oriented in predetermined directions, which creates zones of shadow in a frontal view of the light.

Also known, from U.S. Pat. No. 6,244,731, is a lighting or signaling device composed of a light source, a composite reflector, consisting of a plurality of reflecting surface units and of aspheric lenses corresponding to each of the reflective surface units, and intended to emit a light beam along an optical axis.

The plurality of reflecting surface units is divided into several groups. Each reflecting surface unit is an ellipsoid segment, one focal point of which is centered on the light source, and the second focal point of which is situated on a line passing through the first focal point and inclined on the optical axis. The reflecting surface units of one group are distributed concentrically around the optical axis, so as not to overlap.

The aspherical lenses are convergent, and they are each focused on a second focal point of a reflecting surface element so as to emit parallel light beams in the direction of the optical axis.

The aims of a design of this type are to obtain a new style of lighting or signaling device, with a plurality of lenses visible from the outside of this device, to control the distribution of light inside the light beam resulting from the superimposition of the elementary light beams, and to select the visible illuminated surface of the device. In fact, only the external faces of the aspheric lenses are visible.

SUMMARY OF THE INVENTION

The invention fits into this context and its objective is to remedy the technical disadvantages previously explained by proposing a lighting or signaling module, comprising a main light source, but the lighted appearance of which is that of a module comprising a plurality of visible light sources, the intensity of each of the visible sources being adjustable to any predetermined value, the position of each of the visible sources also being freely selectable in a three-dimensional space, so as to form predetermined patterns, the visible sources having to be visible from relatively large angles of observation, the visible sources themselves having a two-dimensional or three-dimensional appearance, the luminous flux of all the visible sources complying with the legislation relating to the function of lighting or of signaling fulfilled by this lighting or signaling module.

To this end, the present invention proposes a lighting or signaling module for the emission of a light or signaling beam according to a main direction, of the type comprising a light source, a luminous flux recovering mirror comprising a set of reflecting tiles, the reflective surface of each reflecting tile comprising a first conical segment with two focal points, of which a first focal point is situated on the light source and a second focal point is situated, in relation to the reflecting tile, in a specific direction in relation to the main direction, each reflecting tile forming an image of the light source.

According to an embodiment of the invention, the surface of at least one reflecting tile comprises at least one second conical segment with two focal points, a first focal point of which is situated on the light source and a second focal point is situated at a distance from the second focal point of the first conical segment with two focal points.

According to other characteristics of the invention, considered separately or in combination:

- the first conical segments with two focal points constituting the reflecting tiles are segments of ellipsoids of revolution, the second focal points being situated forward of the reflecting tile;
- the first conical segments with two focal points constituting the reflecting tiles are segments of hyperboloids of revolution, the second focal points being situated rearward of the reflecting tile;
- the second focal points of the first conical segment with two focal points are situated, in relation to the reflecting tile, in a direction essentially parallel to the main direction;
- the second focal points of the first conical segment with two focal points are situated, in relation to the reflecting tile, in a direction inclined in relation to the main direction;
- the predetermined photometric characteristics of the second focal points of the first conical segment with two focal points belong to the group comprising the solid angle at which the light rays diverge from the second focal points, and the direction in which the light rays diverge from the second focal points of the first conical segment with two focal points;
- the parameters of the conical segments with two focal points constituting the reflecting tiles belong to the group comprising the solid angle originating from the light source and following the contour of the reflecting tiles, and the parameters of the equations defining the conical segments with two focal points;
- the second focal points of the first conical segment with two focal points are situated in the same plane perpendicular to the main direction of emission of the lighting or signaling beam;
- the dimensions of the second conical segment with two focal points are selected such that the amount of light concentrated on the second focal point has a predetermined intensity;
- the second focal point of the second conical segment with two focal points is situated on the straight line joining the focal points of the first conical segment with two focal points;
- the second focal point of the second conical segment with two focal points is situated outside the straight line joining the focal points of the first conical segment with two focal points;
- the light source is constituted by the filament of an incandescent bulb;
- the light source is constituted by a light-emitting diode;
- an optical device is arranged forward of the light source;
- the optical device is a light shield;
- the optical device is a rear reflector reflecting forward the light rays which reach it.

The invention has the further object of a lighting or signalling device, characterized in that it includes at least two lighting or signaling modules.

These and other objects and advantages of the invention will be apparent from the following description, the accompanying drawings and the appended claims.

BRIEF DESCRIPTION OF THE ACCOMPANYING DRAWINGS

Other aims, characteristics and advantages of the present invention will become clear from the following description of one embodiment, given non-limitatively, making reference to the attached drawings, in which.

DETAILED DESCRIPTION OF THE PREFERRED EMBODIMENTS

Figure 1:
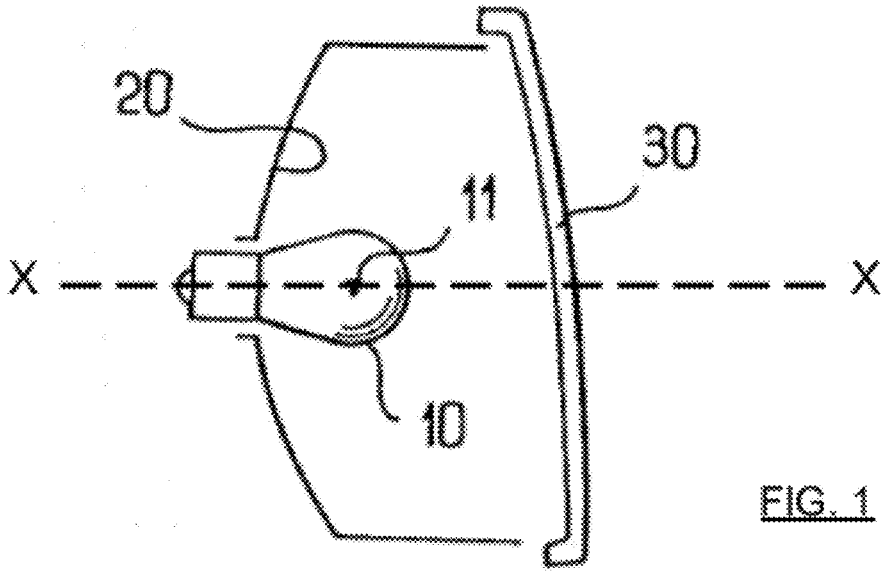
FIG. 1 shows in diagram form a vertical axial section of a signaling module produced in accordance with the teaching of the present invention.

By convention, in the present description, the word "forward" is used to refer to the direction in which the emergent lighting or signaling light beam is emitted, and "rearward" to the opposite direction. In FIG. 1, for example, forward is on the right of the figure, and rearward on the left.

Figure 2:
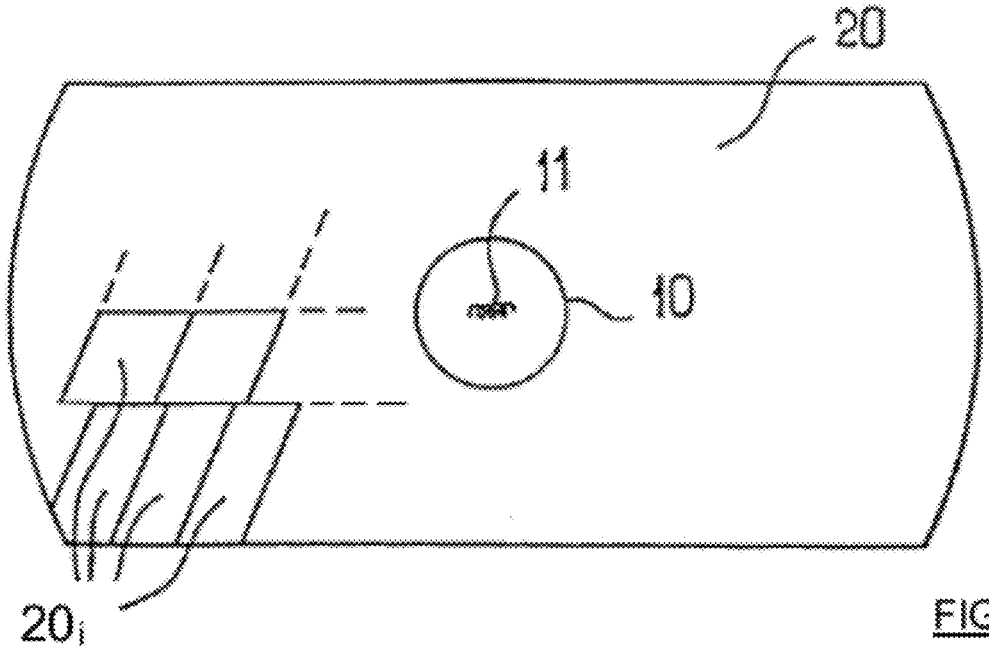
FIG. 2 shows in diagram form a frontal view of the signaling module from FIG. 1.

Referring firstly to FIGS. 1 and 2, these show in diagram form a signal light of a motor vehicle which comprises a light source or filament 11, a luminous flux recovering mirror 20 and a closure glass 30, to emit a lighting or signalling beam according to a main direction X-X. The light source 11 may be constituted, as shown in FIGS. 1 to 3, by the filament 11 of an incandescent bulb 10, or else by a light-emitting diode.

The glass 30 is essentially smooth or slightly deflecting, i.e. it contains no optical member significantly affecting the path of the light rays passing through it.

As shown in FIG. 2, the mirror 20 is formed from a set of reflecting tiles $\mathbf{20}_i$, $\mathbf{20}_j$, which may or may not be contiguous. Each tile $\mathbf{20}_i$, $\mathbf{20}_j$ is constituted by a conical segment with two focal points, the first focal point of which is situated on the filament 11.

Figure 3:
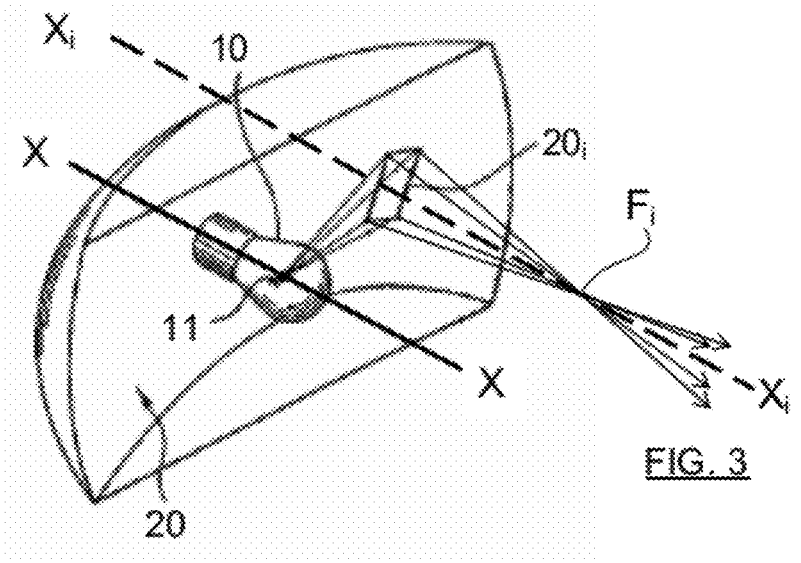
FIG. 3 shows in diagram form a perspectival view of the signaling module from FIGS. 1 and 2, illustrating the path of the light rays emitted by the source.
Figure 4:
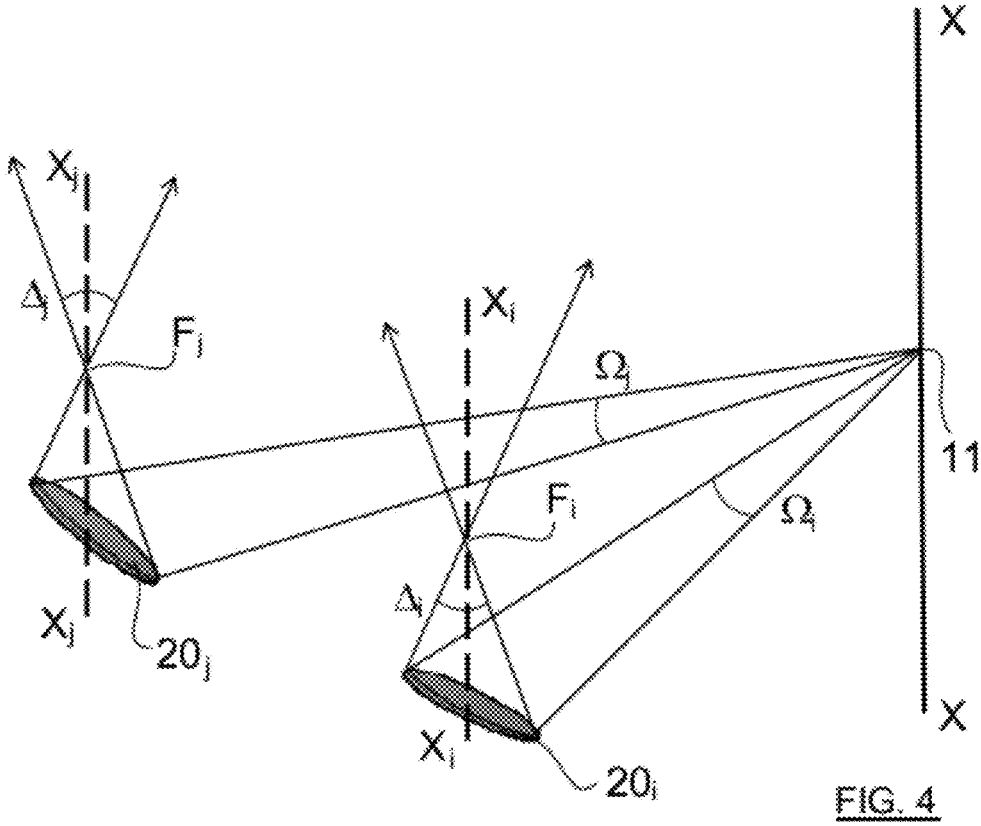
FIG. 4 shows in diagram form the path of the light rays reflected by several tiles of the reflector of the signaling module.

In the embodiment in FIGS. 3 and 4, each tile $\mathbf{20}_i$, $\mathbf{20}_j$ is constituted by an ellipsoid segment, the second focal point $F_i$, $F_j$ of which is situated forward of the tile $\mathbf{20}_i$, $\mathbf{20}_j$, in a specific direction $X_iX_i$, $X_j$-$X_j$.

Figure 5:
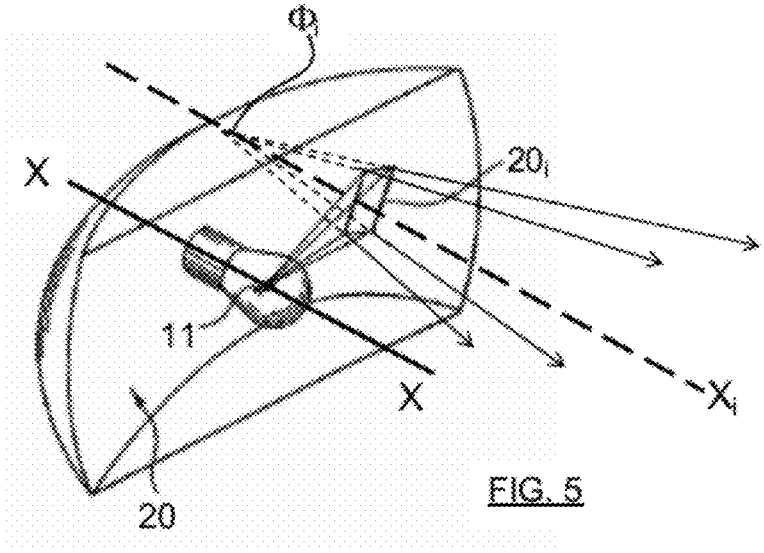
FIG. 5 shows in diagram form a view similar to that in FIG. 3, according to a second embodiment of the tiles of the reflector of the module.
Figure 6:
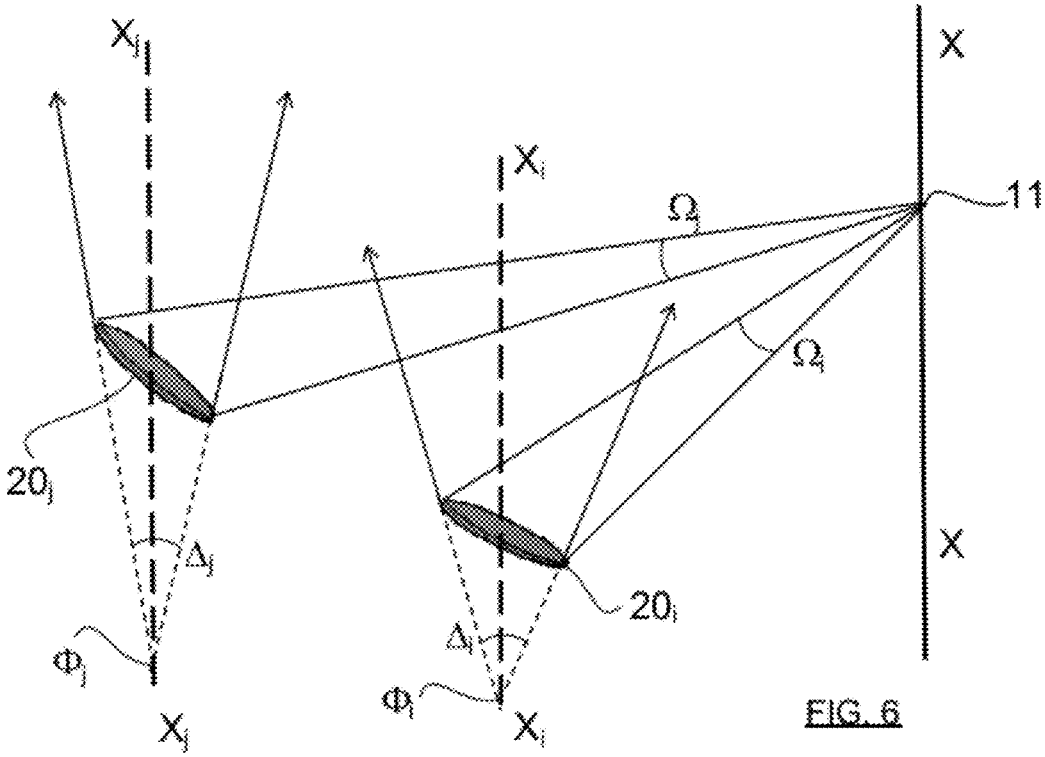
FIG. 6 shows in diagram form a view similar to that in FIG. 4, according to the second embodiment of the tiles of the reflector of the module.

In the embodiment in FIGS. 5 and 6, each tile $\mathbf{20}_i$, $\mathbf{20}_j$ is constituted by a hyperboloid segment, the second focal point $\Phi_i$, $\Phi_j$ of which is situated rearward of the tile $\mathbf{20}_i$, $\mathbf{20}_j$, in a specific direction $X_i$-$X_i$, $X_j$-$X_j$.

The direction $X_i$-$X_i$, $X_j$-$X_j$ may be parallel to the main direction X-X passing through the center of the tile $\mathbf{20}_i$, $\mathbf{20}_j$, as shown in FIGS. 3 to 6. It may also be inclined in relation to this axis X-X. This latter case may arise when one wishes to emit light rays in given directions, to satisfy, for example, a regulatory photometric grid, or to avoid an obstacle which may lie in the path of these light rays, for example an internal wall of the lighting or signaling device in which the module according to the invention is installed.

In the embodiment in FIGS. 3 and 4, each second focal point $F_i$, $F_j$ constitutes a real image of the filament 11. In the embodiment in FIGS. 5 and 6, each second focal point $\Phi_i$, $\Phi_j$ constitutes a virtual image of the filament 11.

The second focal points $F_i$, $F_j$ or $\Phi_i$, $\Phi_j$ may be situated in the same plane perpendicular to the main axis X-X, or they may be distributed freely in three-dimensional space, depending on the appearance one wishes to give to the lighted module. In fact, the spatial arrangement of the second focal points $F_i$, $F_j$ or $\Phi_i$, $\Phi_j$ in relation to the closure glass 30, when they are not coplanar, also gives an impression of depth and of relief to the module when it is lit.

One can thus well imagine that when the bulb 10 is lit, i.e. when the filament 11 is incandescent, each reflecting tile $\mathbf{20}_i$, $\mathbf{20}_j$ forms a real image $F_i$, $F_j$, or a virtual image $\Phi_i$, $\Phi_j$ directly visible through the glass 30, which is smooth or slightly deflecting.

Figure 7:
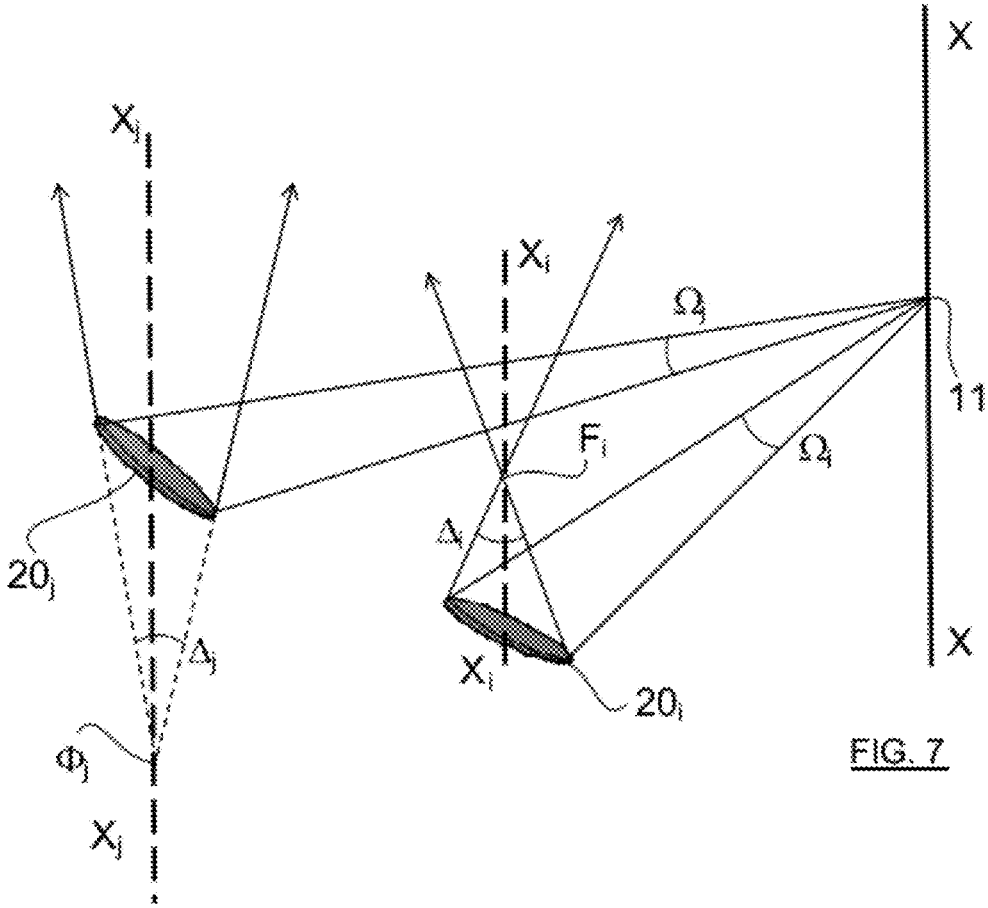
FIG. 7 shows in diagram form a combination of the embodiments from FIGS. 4 and 6.

One may also make provision to combine, as shown in FIG. 7, the embodiments from FIGS. 3 or 4 and 5 or 6, i.e. to provide the mirror 20 with reflecting tiles $\mathbf{20}_i$, $\mathbf{20}_j$ some of which are ellipsoid segments, the second focal points $F_i$, $F_j$ of which are situated forward of the mirror 20 and some of which are hyperboloid segments, the second focal points $\Phi_i$, $\Phi_j$ of which are situated rearward of the mirror 20. Such an embodiment enables even greater flexibility in the design of the mirror 20, depending on the three-dimensional appearance one wishes to give to the module when it is lit.

Figure 8:
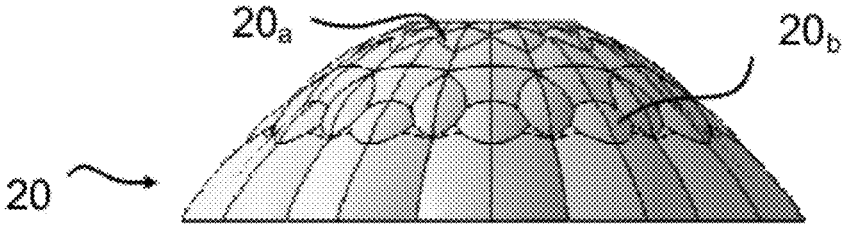
FIG. 8 shows a side view of the rear of a reflector which can be used in the module of the invention.
Figure 9:
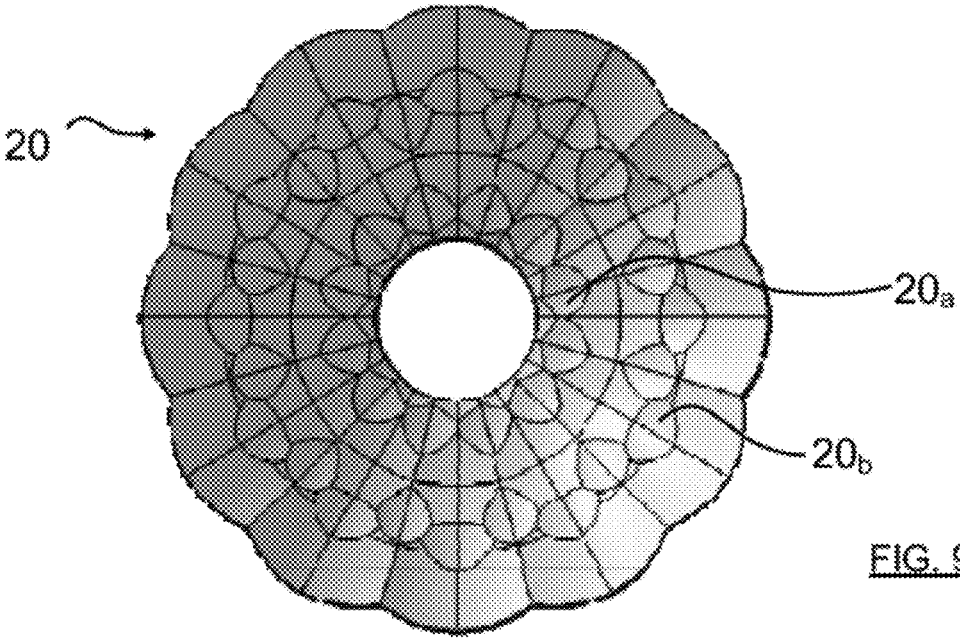
FIG. 9 shows a frontal view of the reflector from FIG. 8.
Figure 10:
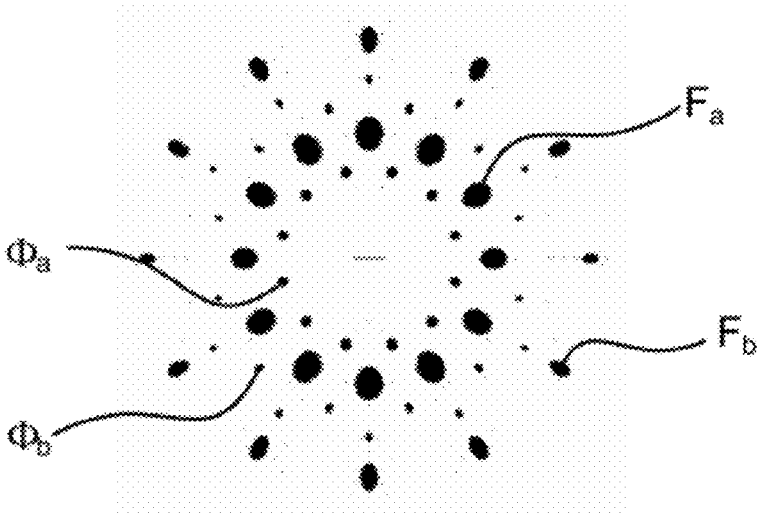
FIG. 10 shows in diagram form the light beam emitted by the signaling module of the invention, equipped with the reflector from FIGS. 8 and 9.

So it is possible to form as many reflecting tiles $\mathbf{20}_i$, $\mathbf{20}_j$ on the mirror 20 as desired, depending on the effect one wishes to give to the lit module. For example, it is possible to form reflecting tiles $\mathbf{20}_a$, $\mathbf{20}_b$ on a mirror 20 as shown in FIGS. 8 and 9. These tiles are formed in concentric circles such that their centers are regularly spaced on these circles. The result is that the real images $F_a$, $F_b$ and/or virtual images $\Phi_a$, $\Phi_b$ of the filament 11 will also be regularly distributed on the concentric circles, as can be seen from FIG. 10, if these real images are situated on the axes $X_i$-$X_i$, $X_j$-$X_j$ parallel to the main direction X-X. The real images $F_a$, $F_b$ and/or virtual images $\Phi_a$, $\Phi_b$ may also be distributed according to any other configuration, with no need for symmetry, selecting inclinations appropriate for the axes $X_i$-$X_i$, $X_j$-$X_j$ in relation to the axis X-X.

Furthermore, the reflecting tiles $\mathbf{20}_i$, $\mathbf{20}_j$ can also be designed so as to predetermine the intensity of the real image $F_a$, $F_b$ and/or virtual image $\Phi_a$, $\Phi_b$. So, as shown in FIGS. 4 and 6, considering that the filament 11 is punctiform, this filament "sees" each reflecting tile $\mathbf{20}_i$, $\mathbf{20}_j$ under a different solid angle $\Omega_i$, $\Omega_j$. So, by selecting the dimensions of each reflecting tile $\mathbf{20}_i$, $\mathbf{20}_j$, it will be possible to determine the quantity of light reflected by each tile and reaching each real image $F_i$, $F_j$ or appearing to originate from each virtual image $\Phi_i$, $\Phi_j$.

In FIG. 4 it can be seen that as a function of the solid angle $\Delta_i$ under which the reflecting tiles $\mathbf{20}_i$ will concentrate the light received from the filament 11 on the associated real image $F_i$, the light rays will diverge from this image $F_i$ under this same solid angle $\Delta_i$. The result is that this image $F_i$ will be fully visible to an observer situated in the solid angle $\Delta_i$ around the mean direction $X_i$-$X_i$.

Equally, FIG. 6 shows that, as a function of the parameters of the hyperboloid surfaces constituting the reflecting tiles $\mathbf{20}_i$, the light rays will diverge from the virtual image $\Phi_i$ under a solid angle $\Delta_i$, rendering this image $\Phi_i$ visible to an observer situated in the solid angle $\Delta_i$ around the mean direction $X_i$-$X_i$.

Moreover, it is known that an ellipsoid is a defined surface in an orthonormated co-ordinate system (Ox, Oy, Oz) selected appropriately by the general equation:

$$\frac{x^2}{a^2} + \frac{y^2}{b^2} + \frac{z^2}{c^2} = 1$$

where a, b and c are strictly positive given parameters, equal to the lengths of the semi-axes of the ellipsoid.

Equally, it is known that a hyperboloid is a defined surface in an orthonormated co-ordinate system (Ox, Oy, Oz) selected appropriately by the general equation:

$$\frac{x^2}{\alpha^2} + \frac{y^2}{\beta^2} - \frac{z^2}{\gamma^2} = 1$$

where $\alpha$, $\beta$ and $\gamma$ are strictly positive given parameters, equal to the lengths of the semi-axes of the hyperboloid.

In this instance, the position of the two focal points of each ellipsoid or of each hyperboloid is known: the first focal point is on the filament 11 of the bulb 10, and the second focal points $F_i$ or $\Phi_i$ are situated at the sites where one wishes to place the real or virtual images of the filament 11, i.e. on the axes $X_i$-$X_i$, parallel or not, to the axis X-X. The origin of the orthonormated co-ordinate system is situated in the middle of the segment joining the two focal points, a first axis passing through the two focal points, and the other two axes are perpendicular to the first axis at the origin of the co-ordinate system and perpendicular to each other.

By making an appropriate choice of parameters a, b and c or $\alpha$, $\beta$ and $\gamma$ as recalled above, it will thus be possible to choose, for example, the orientation of the light beam reflected by each reflecting tile $\mathbf{20}_i$. It would also be possible to design each reflecting tile so that it sends light rays in predetermined directions, either to increase the visibility of the lighting or signaling device or to satisfy a regulatory photometric grid.

This choice of parameters a, b and c or α, β and γ will of course be combined with the choice of the solid angle $\Delta_i$ in which the light rays diverge from $F_i$ or from $\Phi_i$ to determine the quantity of light to be emitted in a particular direction.

In particular, it will be possible to determine the value of this solid angle $\Delta_i$, and hence the angle under which all the images $F_i$ or $\Phi_i$ will be visible. For example, it is possible to produce reflecting tiles $\mathbf{20}_i$ so that they remain fully visible to an observer situated in a direction forming an angle of about 20 degrees in relation to the main direction X-X.

It is also possible to improve the three-dimensional appearance given by the module according to the invention by means of minor modifications to the surface of the reflecting tiles $\mathbf{20}_i$ constituting the flux-recovering mirror. For the sake of clarity, these modifications will now be explained in relation to the tiles whose surface is an ellipsoid segment, but of course the same modifications may be made, mutatis mutandis, to tiles whose surface is a hyperboloid segment.

Figure 11:
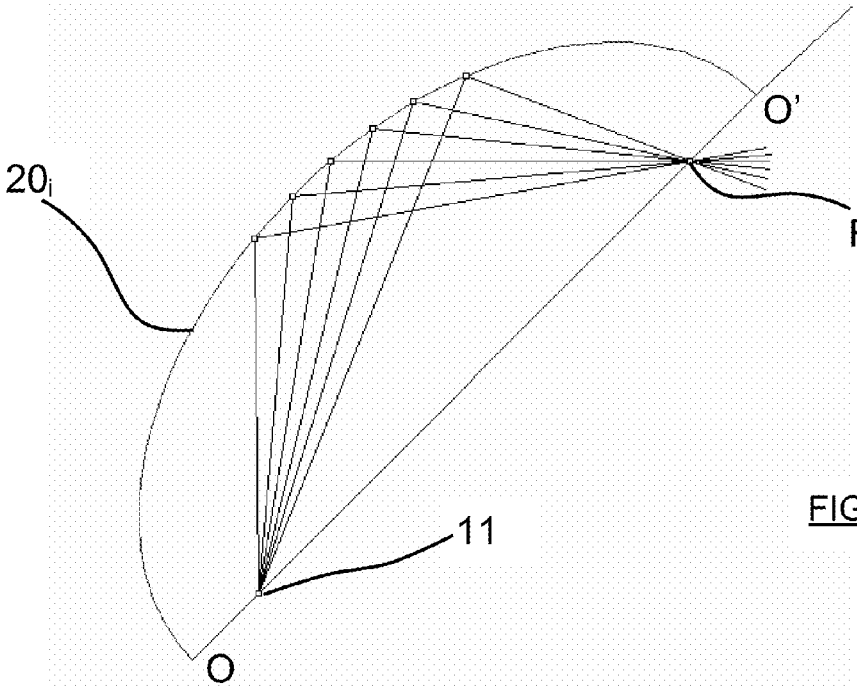
FIG. 11 shows a view similar to that of FIG. 4 showing the course of the light rays reflected by a single tile.

Thus, FIG. 11 shows the surface of an elementary tile $\mathbf{20}_i$ of ellipsoidal shape, associated with the filament 11 placed in its first focal point, and concentrating the light rays emitted by this filament 11 at the second focal point $F_i$, this surface being seen in section through a plane passing through its two focal points 11 and $F_i$.

Figure 12:
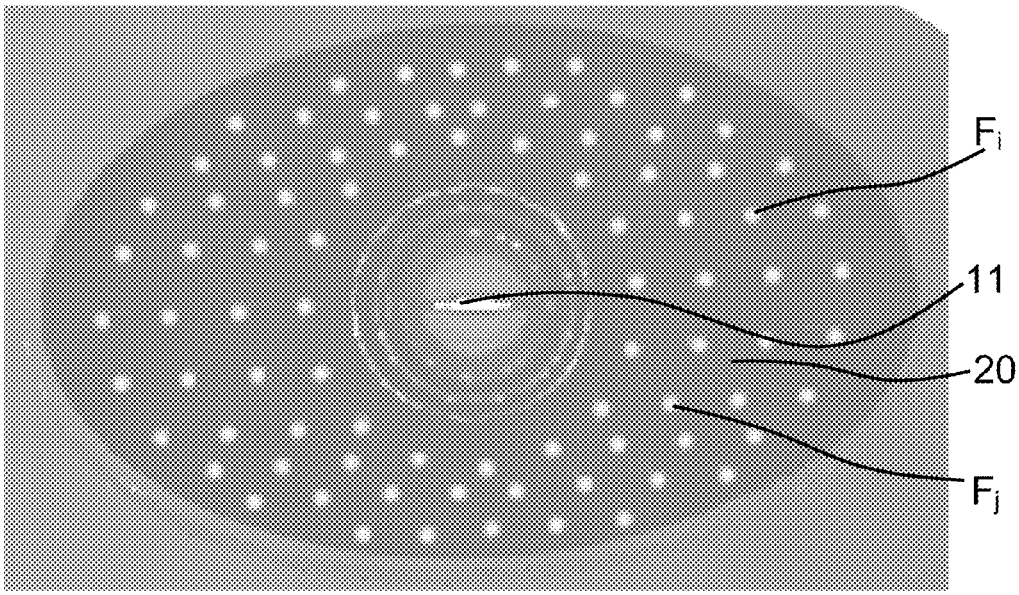
FIG. 12 shows a view similar to that of FIG. 10, showing the light beam emitted by the signaling module of the invention, containing only tiles as shown in FIG. 11.

FIG. 12 shows the light beam emitted by the reflector 20 of the module according to the invention, containing only tiles whose surfaces are as shown in FIG. 11, the reflector being seen from the front. It has been seen earlier that this light beam comprises rays originating from the filament 11 itself, and also rays originating from the different images $F_i$, $F_j$ of this filament, formed by the different tiles $\mathbf{20}_i$, $\mathbf{20}_j$. The images $F_i$, $F_j$ of the filament 11 may be arranged at any predetermined site, as has been seen above, either according to the main direction X-X, perpendicular to the plane of the figure, or perpendicular to this direction, i.e. in the plane of the figure. The images $F_i$, $F_j$ can thus be arranged freely in a three-dimensional space.

To simplify the description of the modifications to be made to the surface of the reflecting tiles as shown in FIG. 11:

- only half of the ellipsoid constituting a tile $\mathbf{20}_i$ is considered, assuming that all of the tile $\mathbf{20}_i$ is constituted by this half-ellipsoid, and
- only the section of this surface through a plane passing through its two focal points 11 and $F_i$ is considered.

Figure 13:
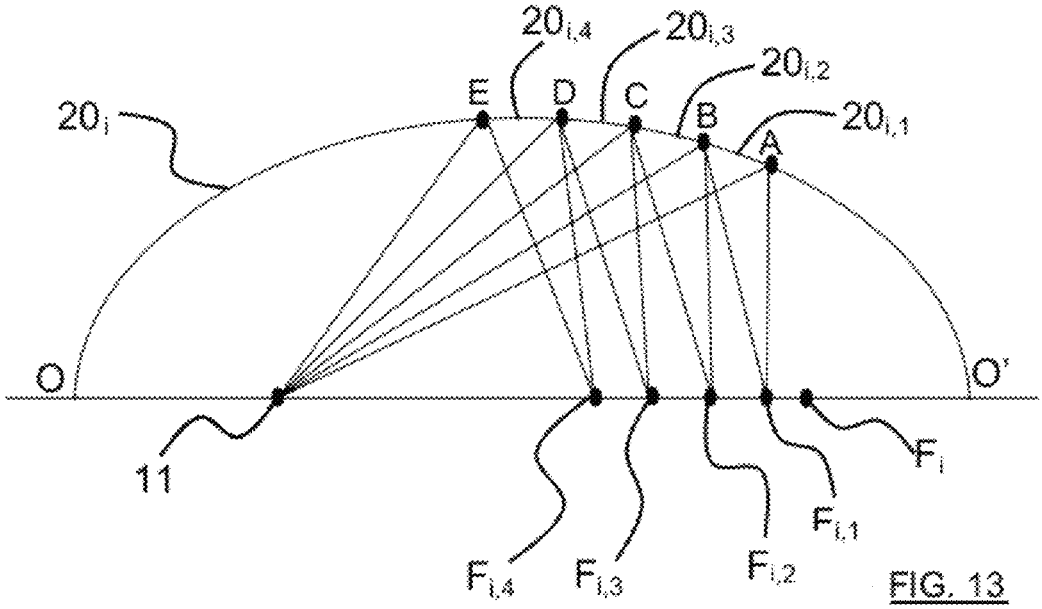
FIG. 13 shows in diagram form a first variant embodiment of the tile from FIG. 11.

As can be seen in FIGS. 11 and 13, O and O' refer to the intersections of the straight line joining the two focal points 11 and $F_i$ with the ellipsoid having these two focal points. So it can be seen from FIGS. 11 and 13 that the whole of the arc (OO') is utilized to concentrate the light originating from the filament 11 on the second focal point $F_i$.

By considering any point A of the arc (OO'), it is still possible to cause to pass through this point an arc (AB) of a second ellipsoid $\mathbf{20}_{i,1}$, having a first focal point situated on the filament 11, in common with the ellipsoid $\mathbf{20}_i$, and a second focal point $F_{i,1}$, situated in proximity to the focal point $F_i$, on the segment of the straight line OO' joining the focal points 11 and $F_i$.

Equally, starting from point B of the second ellipsoid $\mathbf{20}_{i,1}$, it is still possible to cause to pass through this point an arc (BC) of a third ellipsoid $\mathbf{20}_{i,2}$, having a first focal point situated on the filament 11, in common with the ellipsoids $\mathbf{20}_i$ and $\mathbf{20}_{i,1}$, and a second focal point $F_{i,2}$, situated in proximity to the focal point $F_{i,1}$, on the segment of the straight line OO' joining the focal points 11 and $F_i$ and $F_{i,1}$.

By thus proceeding gradually, it is possible to define, for example, from the arcs (AB), (BC), (CD) and (DE) of ellipsoids $\mathbf{20}_{i,1}$, $\mathbf{20}_{i,2}$, $\mathbf{20}_{i,3}$ and $\mathbf{20}_{i,4}$, respectively, concentrating the rays emitted by the filament 11 respectively on the secondary focal points $F_{i,1}$, $F_{i,2}$, $F_{i,3}$, $F_{i,4}$, all situated on the segment of the straight line OO' joining the focal points 11 and $F_i$, their distance from each other.

The focal points $F_{i,1}$, $F_{i,2}$, $F_{i,3}$, $F_{i,4}$ will henceforth be referred to as secondary focal points in relation to focal point $F_i$, all these focal points being associated with the filament 11 by means of the same reflecting tile $\mathbf{20}_i$.

Figure 14:
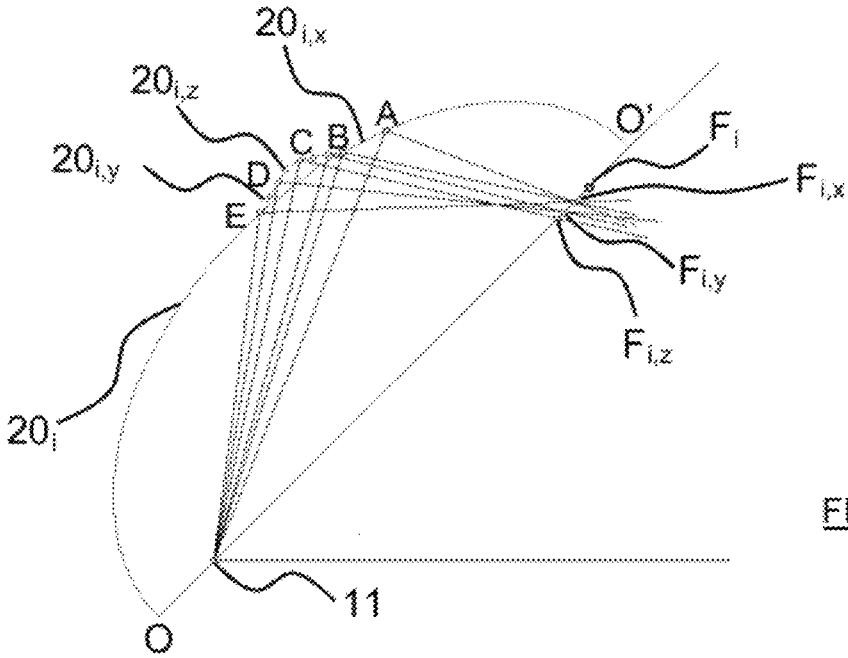
FIG. 14 shows a sectional view of the tile from FIG. 13.
Figure 15:
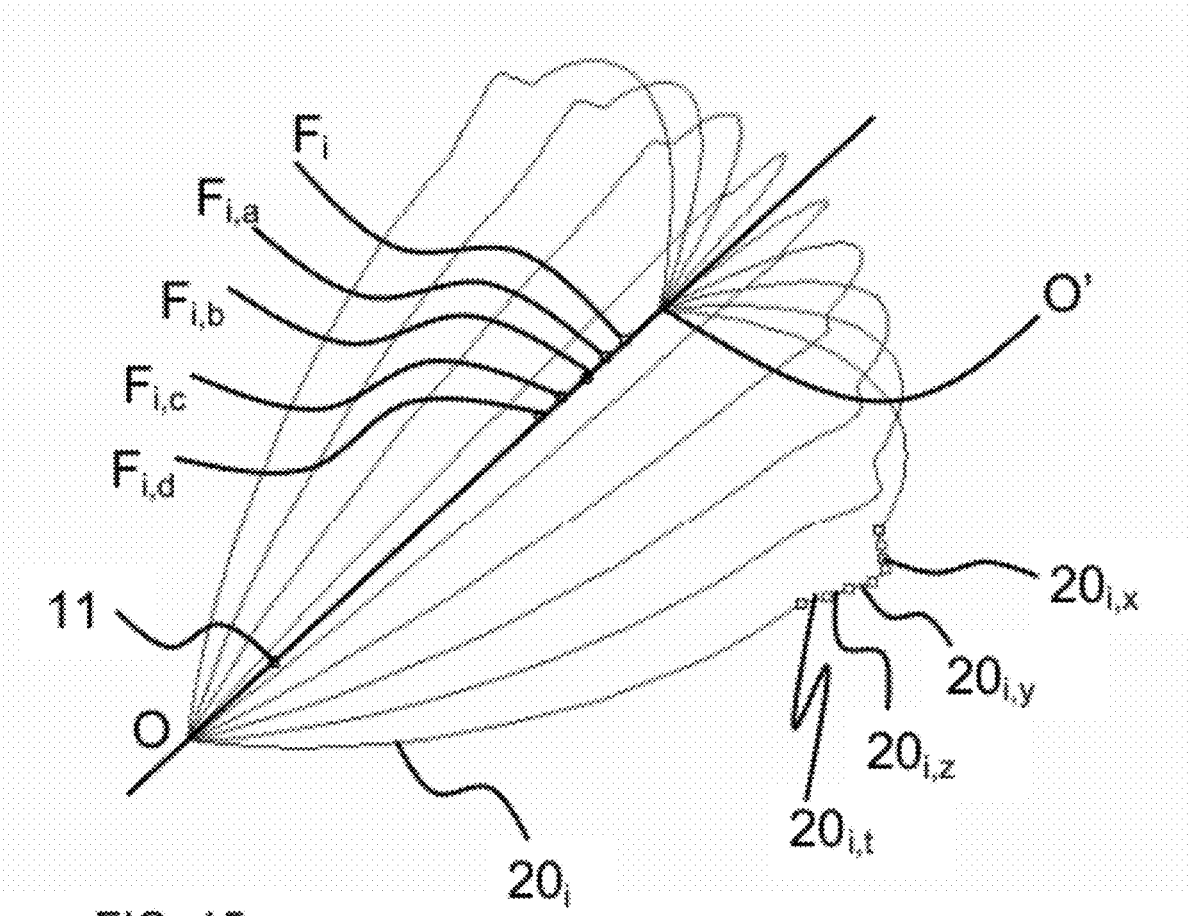
FIG. 15 shows a perspectival view of the tile from FIG. 14.

The ellipsoid resulting from these modifications then takes on, in section, the appearance shown in FIG. 14, where the change in the arcs (AB), (BC), (CD) and (DE) of ellipsoids $\mathbf{20}_{i,x}$, $\mathbf{20}_{i,y}$ and $\mathbf{20}_{i,z}$ has been shown in diagram form, and in perspective the appearance shown in FIG. 15, obtained by rotating FIG. 14 about the segment OO'.

As has been explained in reference to FIGS. 4 and 6, the dimensions can be selected, and inter alia the "length" of the arcs (AB), (BC), (CD) and (DE) so that the quantity of light concentrated by the different ellipsoids $\mathbf{20}_{i,1}$, $\mathbf{20}_{i,2}$, $\mathbf{20}_{i,3}$ and $\mathbf{20}_{i,4}$ on the secondary focal points $F_{i,1}$, $F_{i,2}$, $F_{i,3}$, $F_{i,4}$ respectively has a predetermined intensity.

The result is that it is possible to produce a reflecting tile $\mathbf{20}_i$, constituted by an ellipsoid segment $\mathbf{20}_i$, concentrating the light from a filament 11 situated in its first focal point on a point $F_i$ situated in its second focal point, this ellipsoid segment $\mathbf{20}_i$ itself having zones $\mathbf{20}_{i,1}$, $\mathbf{20}_{i,2}$, $\mathbf{20}_{i,3}$ and $\mathbf{20}_{i,4}$ concentrating the light originating from the same filament 11 on points situated in the secondary focal points $F_{i,1}$, $F_{i,2}$, $F_{i,3}$, $F_{i,4}$ respectively, situated at any predetermined point of the axis OO' joining the two focal points of the ellipsoid $\mathbf{20}_i$, and having any predetermined luminosity, but less than that of the focal point $\mathbf{20}_i$.

Figure 16:
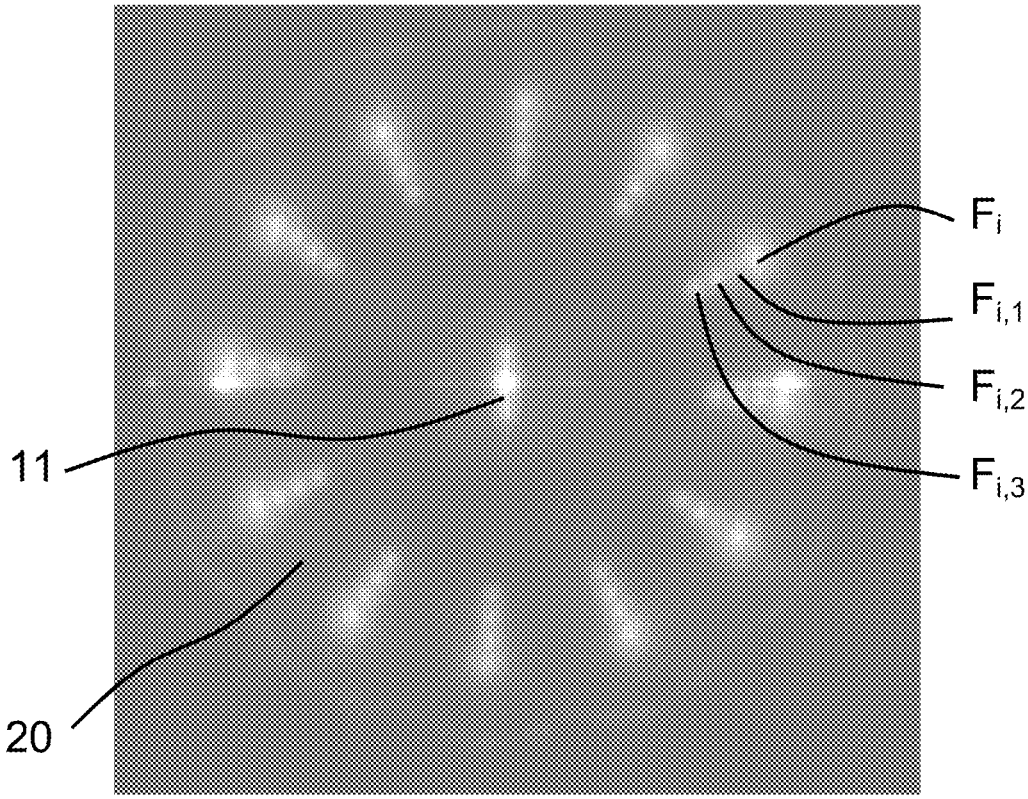
FIG. 16 shows a first example of a light beam emitted by the signaling module of the invention, the reflector being formed from tiles shown in FIG. 15.

This can in fact been seen in FIG. 16, which shows the light beam emitted by a signaling module fitted with a reflector 20 constituted by tiles like those shown in FIG. 15, the reflector 20 being seen from the front.

It can be seen in FIG. 16 that the light beam comprises rays originating from the filament 11 itself, and rays originating from the different images $F_i$, $F_{i,x}$, $F_{i,y}$, $F_{i,z}$, of this filament, formed by the different tiles $\mathbf{20}_i$, $\mathbf{20}_{i,x}$, $\mathbf{20}_{i,y}$ and $\mathbf{20}_{i,z}$.

As has been seen above, the images $F_i$ can be arranged at any predetermined point in a three-dimensional space, while having any predetermined luminosity. Equally, the secondary images $F_{i,x}$, $F_{i,y}$, $F_{i,x}$, generated by the same tile $\mathbf{20}_i$ can be arranged at any predetermined point of the axis joining the image $F_i$ to the filament 11, while having any predetermined luminosity, preferably that of the image $F_i$.

As shown in FIG. 16, it will thus be possible to arrange the secondary images $F_{i,x}$, $F_{i,y}$, $F_{i,z}$ so that they diverge regularly from the image $F_i$, while having decreasing luminosities. One can thus reinforce the impression of volume or of depth given by all the images $F_i$ and the associated secondary images $F_{i,x}$, $F_{i,y}$, $F_{i,z}$, these latter giving an effect of lines "receding" in relation to the images $F_i$.

This effect or this impression can be further reinforced. In fact, if, returning to FIG. 13, it is considered that the arc (AE) is intended to create the secondary images $F_{i,x}$, $F_{i,y}$, $F_{i,z}$, $F_{i,t}$, the diminished arc (OO') of arc (AE) being intended to create the sole image $F_i$.

One can then retain the length of the arc (AE), but divide it into elementary arcs (AB), (BC), (CD), etc. in greater number, and thus each having a lesser length, so as to increase the number of secondary images $F_{i,x}$, $F_{i,y}$, $F_{i,z}$, $F_{i,t}$. So, if one causes the length of an elementary arc (AB), (BC), (CD), etc. to tend towards zero, the number of these elementary arcs will increase to infinity, as will the number of secondary images $F_{i,x}$, $F_{i,y}$, $F_{i,z}$, $F_{i,t}$.

Figure 17:
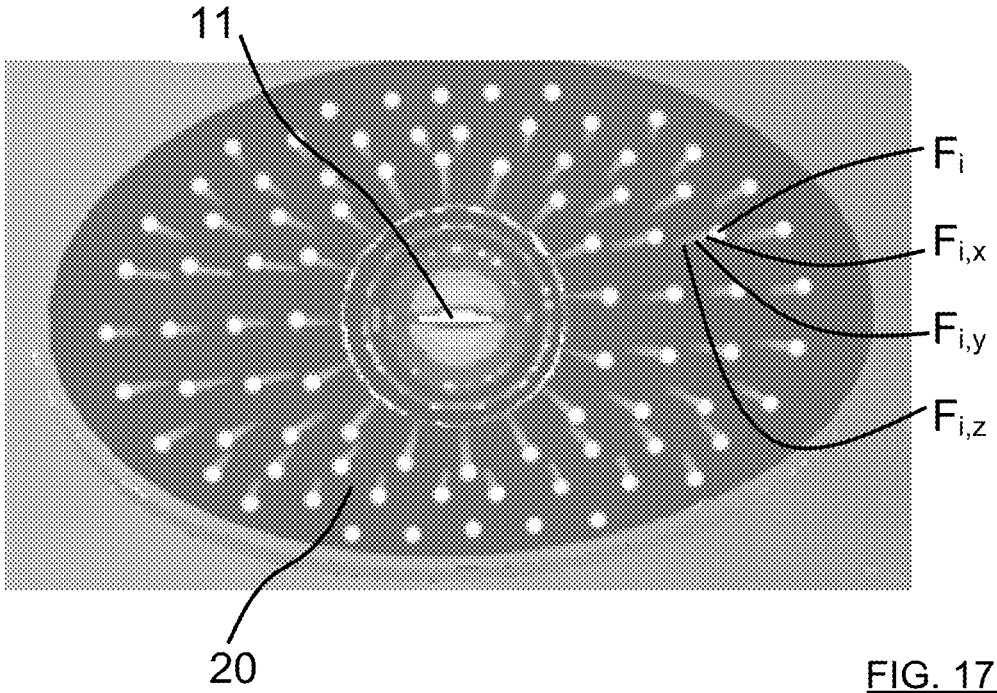
FIG. 17 shows a second example of a light beam emitted by the signaling module of the invention, the reflector formed from tiles shown in FIG. 15.

This can in fact be seen in FIG. 17, where the secondary images $F_{i,x}$, $F_{i,y}$, $F_{i,z}$, $F_{i,t}$ form a trail from each image $F_i$, trail pointing towards the filament 11. Each image $F_i$, associated with its secondary images $F_{i,x}$, $F_{i,y}$, $F_{i,z}$, $F_{i,t}$ thus gives the illusion of a "comet" coming from the filament 11.

As a variant, it is possible to provide that the "tail" of the "comets" just described is not pointing towards the filament 11, but may adopt any orientation desired, and is not even necessarily rectilinear.

In fact, for a tile $\mathbf{20}_i$, the definition of the elementary arcs (AB), (BC), (CD), etc. on the same arc (OO') implies that the secondary images $F_{i,x}$, $F_{i,y}$, $F_{i,z}$, $F_{i,t}$ are arranged along the same axis 11, $F_i$, these secondary images $F_{i,x}$, $F_{i,y}$, $F_{i,z}$, $F_{i,t}$ being generated by the secondary ellipsoids $\mathbf{20}_{i,x}$, $\mathbf{20}_{i,y}$, $\mathbf{20}_{i,z}$ and $\mathbf{20}_{i,t}$ obtained by the rotation about the axis OO' of the arcs (AB), (BC), (CD) and (DE) as defined above.

So if one considers the arcs $\mathbf{20}_{i,\alpha}$, $\mathbf{20}_{i,\beta}$, $\mathbf{20}_{i,\gamma}$ contained in the planes passing through O and O' and forming an angle to each other, it will be possible to concentrate the light originating from the filament 11 on the secondary focal points $F_{i,\alpha}$, $F_{i,\beta}$, $F_{i,\gamma}$ which will be situated outside the axis OO'.

Figure 18:
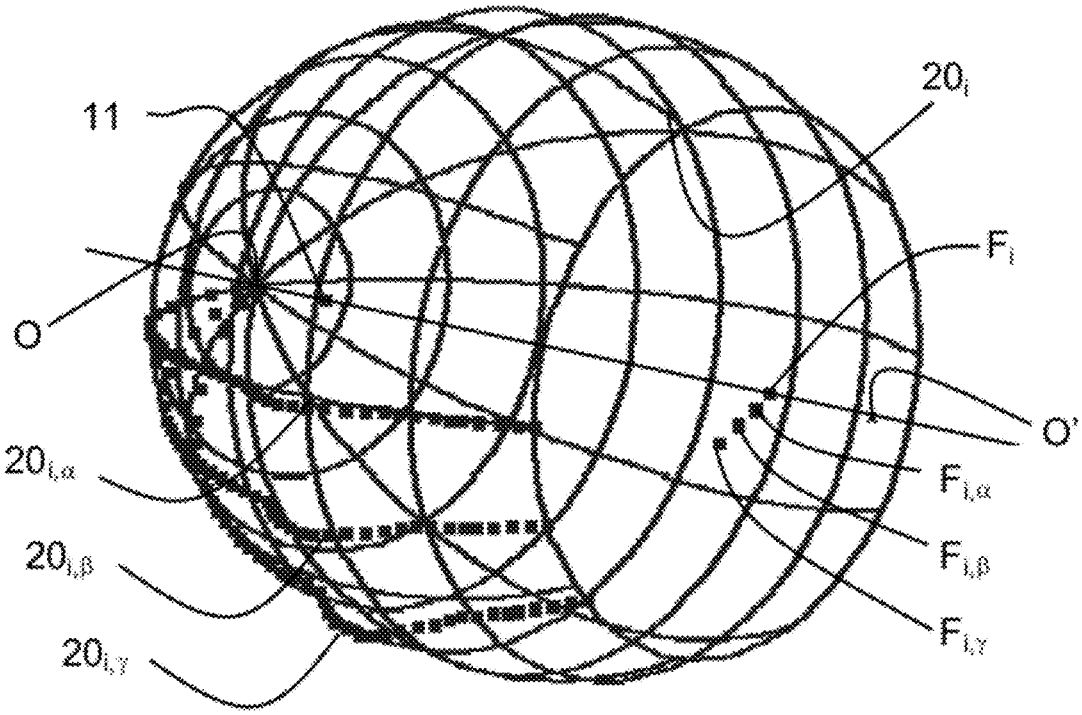
FIG. 18 shows a perspectival view of a second variant embodiment of the tile from FIG. 11.

This is shown in FIG. 18, where it can be seen that the secondary focal points $F_{i,\alpha}$, $F_{i,\beta}$, $F_{i,\gamma}$ are distributed along a segment perpendicular to the axis OO'. Each secondary image $F_{i,\alpha}$, $F_{i,\beta}$, $F_{i,\gamma}$ is situated at the second focal point of an ellipsoid $\mathbf{20}_\alpha$, $\mathbf{20}_\beta$, $\mathbf{20}_\gamma$ the first focal point of which is situated on the filament 11. The ellipsoids $\mathbf{20}_\alpha$, $\mathbf{20}_\beta$, $\mathbf{20}_\gamma$, which are not shown for the clarity of the drawing, are constituted by spindles having as tips the points O and O', and having as median lines the arcs $\mathbf{20}_{i,\alpha}$, $\mathbf{20}_{i,\beta}$, $\mathbf{20}_{i,\gamma}$.

As in the preceding embodiment, provision may be made that the secondary images $F_{i,\alpha}$, $F_{i,\beta}$, $F_{i,\gamma}$ are distributed discretely, and separated from each other, or form a continuous "trail" decreasing from the image $F_i$, as a function of the dimensions given to the spindles $\mathbf{20}_\alpha$, $\mathbf{20}_\beta$, $\mathbf{20}_\gamma$.

One has thus in fact produced a lighting or signaling device comprising a single light source and the lit appearance of which is that of a module comprising a multitude of light sources. The position of each of these sources may be defined so as to form any geometric patterns whatever, the intensity of the sources being adjustable to any predetermined value. It has been seen that these choices are possible without having to use dioptric elements, which generate light losses. The light output of the module according to the invention is thus optimal. What is more, the ellipsoidal and/or hyperboloid surfaces enable better recovery of the luminous flux emitted by the primary source than in the case of paraboloid surfaces. The reflecting mirror being constructed from ellipsoid and/or hyperboloid segments, any discontinuities between these different segments are by and large less than those which would be generated by multifocal paraboloid surfaces.

The lighting or signaling device just described could thus be used simply to perform a regulatory function of lighting or signaling, such as a rear light, brake light, change of direction indicator or reversing light. It would also be possible to produce lighting or signaling devices using several modules. It is thus possible to obtain a signaling function with a completely new appearance.

Obviously, the present invention is not limited to the embodiments which have been described, but the person skilled in the art will, on the contrary, bring to it many modifications which fall within its scope. So, although the "comet" effect has been described in relation to the tiles which are ellipsoid segments, this same effect can be obtained, mutatis mutandis, with tiles which are hyperboloid segments. One can thus make provision that certain of the reflecting tiles are constructed on ellipsoids, while others will be constructed on hyperboloids, while still others, ellipsoids or hyperboloids, will be designed to concentrate only the rays originating from the filament on a single image, depending on the final effect desired.

So it is also possible to provide, in front of the light source, an optical device such as a light shield designed to conceal the primary source, so that an observer is able to see only the real or virtual images of this primary source. This optical device could also be constituted by a rear reflector, reflecting forward the light rays which reach it, originating, for example, from the lighting devices of other vehicles, so that the module according to the present invention, in addition to its function of lighting or of signaling, also fulfils this regulatory signaling function.

According to the invention, if desired, the edges of the tiles are essentially undetectable to the naked eye.

If need be, the tiles are not associated with an optical diffuser.

In particular, the invention is not intended to obtain a homogeneous appearance of the lighting.

According to the present invention, the module makes it possible to obtain secondary light sources which appear as sources which are distinct from each other.

While the forms of apparatus herein described constitutes preferred embodiments of this invention, it is to be understood that the invention is not limited to these precise forms of apparatus, and that changes may be made therein without departing from the scope of the invention which is defined in the appended claims.

What is claimed is:

1. A lighting or signaling module for emitting a light or signaling beam according to a main direction, comprising a light source, a mirror recovering luminous flux projected by the light source comprising a set of reflecting tiles, the reflective surface of each reflecting tile comprising a first conical segment with two focal points, of which a first focal point is situated on the light source and of which a second focal point is situated, in relation to the reflecting tile in a specific direction in relation to the main direction, each reflecting tile forming an image of the light source at the second focal point, wherein a surface of at least one reflecting tile comprises at least one second conical segment with two focal points of which a first focal point is situated on the light source and of which a second focal point is situated in proximity to the second focal point of the first conical segment with two focal points.

2. The module according to claim 1, wherein the first conical segments with two focal points of the reflecting tiles are ellipsoids of revolution, the second focal points being situated forward of the reflecting tile.

3. The module according to claim 1, wherein the first conical segments with two focal points of the reflecting tiles are segments of hyperboloids of revolution, the second focal points being situated rearward of the reflecting tile.

4. The module according to claim 2, wherein the second focal point of the first conical segment with two focal points are situated, in relation to the reflecting tile, in a direction essentially parallel to the main direction.

5. The module according to claim 4, wherein the predetermined photometric characteristics of the second focal points of the first conical segment with two focal points belong to the group comprising the solid angle in which the light rays diverge from the second focal points of the first conical segment with two focal points, and the direction in which the light rays diverge starting from the second focal points.

6. The module according to claim 4, wherein the parameters of the first conical segment with two focal points constituting the reflecting tiles belong to the group comprising the solid angle having as origin the light source and following the contour of the reflecting tiles, and the parameters of the equations defining the first conical segment with two focal points.

7. The module according to claim 1, wherein the second focal points of the first conical segment with two focal points are situated in the same plane perpendicular to the main direction of emission of the lighting or signaling beam.

8. The module according to claim 1, wherein the dimensions of the second conical segment with two focal points are selected such that the quantity of light concentrated on the second focal point has a predetermined intensity.

9. The module according to any claim 1, wherein the second focal point of the second conical segment with two focal points is situated on the straight line joining the focal points of the first conical segment with two focal points.

10. The module according to any claim 1, wherein the second focal point of the second conical segment with two focal points is situated outside of the straight line joining the focal points of the first conical segment with two focal points.

11. The module according to claim 1, wherein the light source consists of the filament of an incandescent bulb.

12. The module according to claim 1, wherein the light source consists of a light-emitting diode.

13. The module according to claim 1, wherein an optical device is arranged forward of the light source.

14. The module according to claim 13, wherein the optical device is a light shield.

15. The module according to claim 13, wherein the optical device is a reflector reflecting forward the rays of light which reach it.

16. A lighting or signaling device for a motor vehicle, wherein said lighting or signaling device comprises at least two lighting or signaling modules according to claim 1.

17. The module according to claim 3, wherein the second focal points of the first conical segment with two focal points are situated, in relation to the reflecting tile, in a direction essentially parallel to the main direction.

18. The module according to claim 3, wherein the second focal points of the first conical segment with two focal points are situated, in relation to the reflecting tile, in a direction which is inclined in relation to the main direction.

19. A lighting or signaling module for emitting a light or signaling beam according to a main direction, of the type comprising a light source, a mirror recovering luminous flux projected by the light source comprising a set of reflecting tiles, the reflective surface of each reflecting tile comprising a first conical segment with two focal points, of which a first focal point is situated on the light source and of which a second focal point is situated, in relation to the reflecting tile in a specific direction in relation to the main direction, each reflecting tile forming an image of the light source at the second focal point, wherein a surface of at least one reflecting tile comprises at least one second conical segment with two focal points of which a first focal point is situated on the light source and of which a second focal point is situated in proximity to the second focal point of the first conical segment with two focal points;

wherein the first conical segments with two focal points of the reflecting tiles are ellipsoids of revolution, the second focal points being situated forward of the reflecting tile;

wherein the second focal points of the first conical segment with two focal points are situated, in relation to the reflecting tile, in a direction which is inclined in relation to the main direction.

20. The module according to claim 19, wherein the predetermined photometric characteristics of the second focal points of the first conical segment with two focal points belong to the group comprising the solid angle in which the light rays diverge from the second focal points of the first conical segment with two focal points, and the direction in which the light rays diverge starting from the second focal points.

21. The module according to claim 19, wherein the parameters of the first conical segment with two focal points constituting the reflecting tiles belong to the group comprising the solid angle having as origin the light source and following the contour of the reflecting tiles, and the parameters of the equations defining the first conical segment with two focal points.

* * * * *